US010119350B2

(12) United States Patent
Lehr

(10) Patent No.: US 10,119,350 B2
(45) Date of Patent: Nov. 6, 2018

(54) EXPANDABLE JUNK MILL

(71) Applicant: BAKER HUGHES, A GE COMPANY, LLC, Houston, TX (US)

(72) Inventor: Douglas J. Lehr, The Woodlands, TX (US)

(73) Assignee: BAKER HUGHES, A GE COMPANY, LLC

( * ) Notice: Subject to any disclaimer, the term of this patent is extended or adjusted under 35 U.S.C. 154(b) by 252 days.

(21) Appl. No.: 15/165,986

(22) Filed: May 26, 2016

(65) Prior Publication Data

US 2017/0342791 A1 Nov. 30, 2017

(51) Int. Cl.
*E21B 29/00* (2006.01)
*E21B 10/42* (2006.01)

(52) U.S. Cl.
CPC ..... *E21B 29/00* (2013.01); *E21B 10/42* (2013.01); *E21B 29/005* (2013.01)

(58) Field of Classification Search
CPC ..... E21B 29/005; E21B 10/32; E21B 10/325
See application file for complete search history.

(56) References Cited

U.S. PATENT DOCUMENTS 1,360,908 A * 11/1920 Everson ..... E21B 10/66 175/265
1,439,093 A * 12/1922 Gibson, Jr. ..... E21B 10/32 175/288
1,468,509 A * 9/1923 Overman ..... E21B 10/34 175/265
1,838,467 A * 12/1931 Stokes ..... E21B 10/66 175/260
2,815,932 A * 12/1957 Wolfram ..... E21B 10/66 173/138
3,051,255 A * 8/1962 Deely ..... E21B 10/32 175/265
3,365,010 A * 1/1968 Howell ..... E21B 10/32 175/286
4,357,122 A 11/1982 Hollis, Jr. et al.
4,842,083 A * 6/1989 Raney ..... E21B 10/43 175/325.4
5,361,859 A * 11/1994 Tibbitts ..... E21B 10/20 175/286
5,560,440 A * 10/1996 Tibbitts ..... E21B 10/20 175/286
5,720,349 A 2/1998 Pleasants et al.
(Continued)

OTHER PUBLICATIONS

Dictionary definition of "Hooke's Law" accessed Mar. 31, 2018 via thefreedictionary.com.*

*Primary Examiner* — Blake E Michener
(74) *Attorney, Agent, or Firm* — Shawn Hunter

(57) ABSTRACT

A borehole mill has blades that extend radially while moving along an inclined dovetail as a result of setting down weight on a mandrel. The blades extend axially beyond the end of the mandrel so that setting down weight disables a retainer that has the blades retracted for running in. Axial displacement of the blades along respective dovetails breaks a shear pin on a follower sleeve that is spring biased off a gage ring on the mandrel such that the spring stays compressed as long as set down weight is applied and once the mill is picked up the spring pushes the blades axially along a dovetail to the radially retracted position. The mill resumes its smallest dimension for pulling out of the hole.

17 Claims, 1 Drawing Sheet

(56) References Cited

U.S. PATENT DOCUMENTS

| | | | | |
|---|---|---|---|---|
| 6,131,675 | A * | 10/2000 | Anderson | E21B 10/322 166/55.1 |
| 6,615,933 | B1 | 9/2003 | Eddison | |
| 6,953,096 | B2 * | 10/2005 | Gledhill | E21B 10/322 175/267 |
| 7,195,085 | B2 * | 3/2007 | Pia | E21B 10/345 175/263 |
| 8,122,977 | B2 * | 2/2012 | Dewey | E21B 10/62 175/284 |
| 8,439,135 | B2 * | 5/2013 | Lyon | E21B 4/06 175/272 |
| 8,561,724 | B2 | 10/2013 | Xu | |
| 8,881,845 | B2 * | 11/2014 | Dewey | E21B 10/62 175/285 |
| 2002/0070052 | A1 | 6/2002 | Armell et al. | |
| 2003/0183424 | A1 * | 10/2003 | Tulloch | E21B 10/322 175/263 |
| 2004/0222022 | A1 | 11/2004 | Nevlud et al. | |
| 2006/0096785 | A1 * | 5/2006 | Walter | E21B 10/32 175/267 |
| 2007/0102195 | A1 * | 5/2007 | Denoix | E21B 10/32 175/414 |
| 2010/0175928 | A1 * | 7/2010 | Lee | E21B 10/32 175/414 |
| 2015/0361726 | A1 * | 12/2015 | Ilhein | E21B 10/322 175/284 |
| 2018/0051524 | A1 * | 2/2018 | Esparza | E21B 17/1014 |

* cited by examiner

EXPANDABLE JUNK MILL

FIELD OF THE INVENTION

The field of the invention is borehole milling tools and more particularly milling tools that increase in radial dimension mechanically when in proximity of the object to be milled.

BACKGROUND OF THE INVENTION

Sometimes objects need to be milled out of a borehole. One such occasion is fracturing where a series of barriers such as plugs are set to isolate zones for delivery of high pressure fluid. After the zones are treated the barriers are commonly milled out. In some wells tubular patches have been installed for a variety of reasons such as to cover perforations that no longer producing or to reinforce the tubular string to address a variety of issues in the wall of the tubular. These patches known also as clads can be applied after the plugs are in position that later need to be milled out. The presence of a clad reduces the drift dimension for a mill so it can pass through. This reduction in diameter to clear an obstruction increases the milling time and can result in incomplete milling because the peripheral parts of the plug are not reached by a mill made smaller to clear the smallest drift dimension that will be encountered.

Fixed outer dimension blades on mills such as illustrated in U.S. Pat. No. 5,720,349 have limited utility in such applications. One approach to the problem in the past has been to use applied pressure to move a piston in the mill that axially shifts a camming member having multiple ramp surfaces with the result being that the blades are pushed out radially through a surrounding opening as a result of the camming action. A good example of such a design is U.S. Pat. No. 8,561,724. Other examples in the same vein are U.S. Pat. No. 6,615,933; US 2002/0070052 and US 2004/0222022. U.S. Pat. No. 4,357,122 shows blades inserted into sockets on a mandrel for an end mill. The blades are fixed once installed giving the mill a constant outer dimension.

The pressure operated mills with extendable blades are expensive to build and require an array of seals that need to function in a hostile environment. Seal failures can mean that the blades either fail to extend or only partially extend. Additionally these mills tend to have large outer dimensions for the mandrel assembly as there is typically an annular cavity around the mandrel that is accessed by a port from the mandrel passage so that an annular piston can be pushed to axially shift camming members for blade extension. The camming mechanism can easily jam as it depends on axial actuator movement that then forces a taper under a blade so that the blade movement is exclusively radial. While some of these designs feature a return spring to retract the cam axially out from under the blade that has been pushed out radially, the reality is that the nature of such movements creates a real risk for a jam to an extent that the return spring will not be powerful enough to retract the blades to allow mill removal.

The present invention avoids the cost and complexity of pressure actuated blades that are cammed to move in a radial direction with a simple and innovative design that relies on set down weight on the blades to move them along a dovetail so that they radially extend as they are pushed relatively axially with respect to the mandrel. The blades are secured for running in so that the mill outer periphery is at the smallest dimension. Setting down weight releases a retainer and energizes a return spring that is held compressed during milling. Picking up the mill allows the spring to reverse the blade movement with respect to the mandrel for retraction of the blades. These and other aspects of the present invention will become more apparent from a review of the description of the preferred embodiment and the associated drawings while recognizing that the full scope of the invention is to be determined from the appended claims.

SUMMARY OF THE INVENTION

A borehole mill has blades that extend radially while moving along an inclined dovetail as a result of setting down weight on a mandrel. The blades extend axially beyond the end of the mandrel so that setting down weight disables a retainer that has the blades retracted for running in. Axial displacement of the blades along respective dovetails breaks a shear pin on a follower sleeve that is spring biased off a gage ring on the mandrel such that the spring stays compressed as long as set down weight is applied and once the mill is picked up the spring pushes the blades axially along a dovetail to the radially retracted position. The mill resumes its smallest dimension for pulling out of the hole.

DETAILED DESCRIPTION OF THE PREFERRED EMBODIMENT

Figure 1:
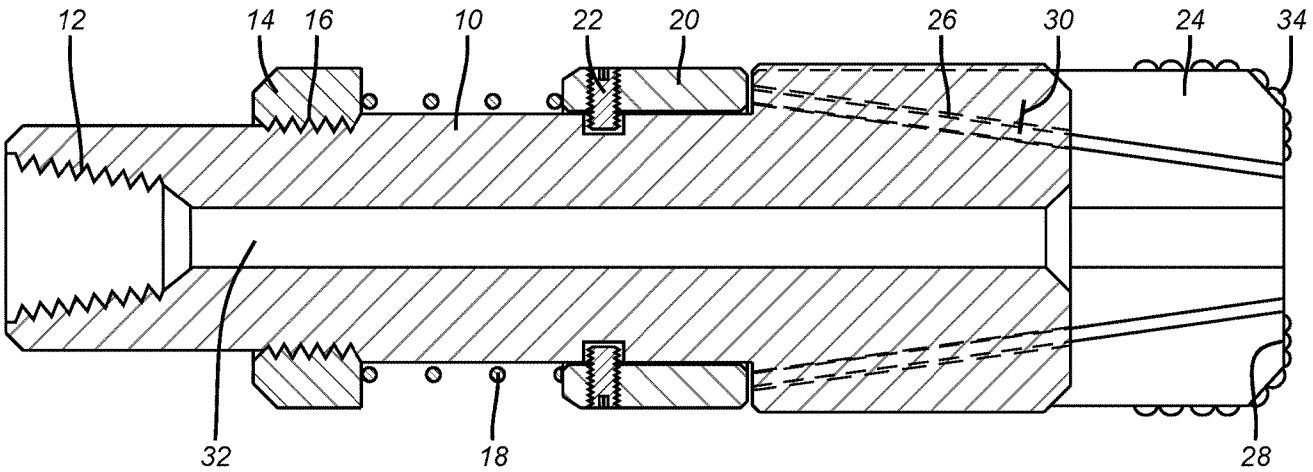
FIG. 1 is the run in position of the mill with the blades radially retracted.

Referring to FIG. 1, a mandrel 10 has a connection 12 for support from coiled or rigid tubing that is not shown. Typically with coiled tubing for the support there will also be a downhole motor to rotate the mandrel while a rigid tubing support string allows imparting rotation to mandrel 10 from a surface location. The mandrel 10 has a gage ring 14 that represents the largest dimension when running in. Ring 14 can be secured with thread 16 to the mandrel 10. Ring 16 is also a support for a coiled or other type of spring 18. Alternatively, Belleville washers or a compressed gas in a variable volume chamber can be used as equivalents to create a bias force against follower 20. Follower 20 is initially shear pinned or releasably secured to the mandrel 10 for running in. The shear pin 22 prevents movement of blades 24 along a rail such as a dovetail 26 into the FIG. 2 extended position in the event the lower ends 28 of blades 24 encounter a projection on the way to the object to be milled. A schematically represented travel stop 30 prevents the blades 24 from separating from the mandrel 10. Mandrel 10 has a passage 32 that conducts fluid from above past the blades 24 and up the hole to remove cuttings. Blades 24 have cutting structure such as carbide or hardened inserts along the bottom end 28 and continuing up the to the vertical sides of the blades 24 as shown in FIG. 1.

Figure 2:
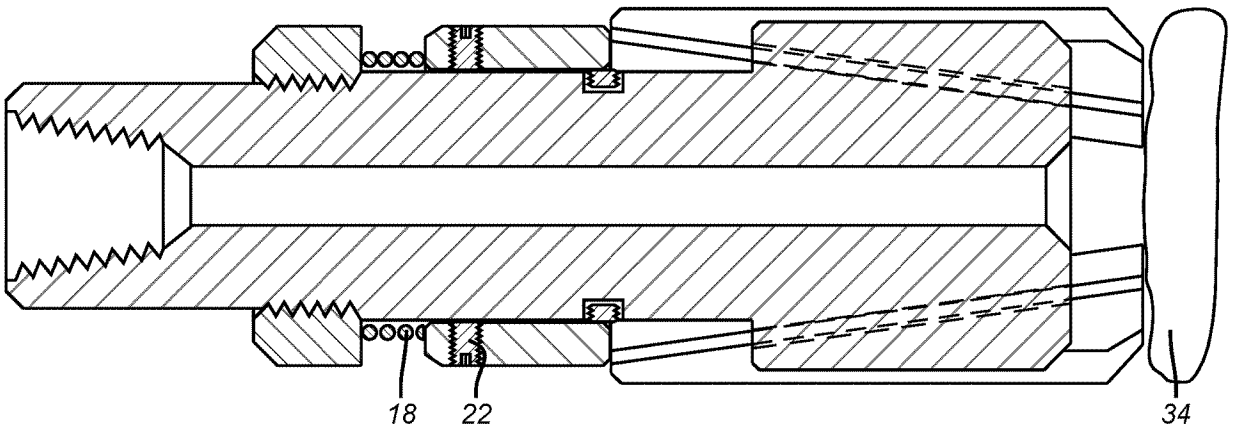
FIG. 2 is the view of FIG. 1 with the blades radially extended due to setting down weight.

In the FIG. 2 position the blades 24 have landed on the object 34 to be milled and the shear pins 22 are broken with spring 18 compressed as the blades 24 displace the follower 20. As a result of the axial relative movement between the blades which are against the object 34 to be milled and the mandrel 10 the blades also extend further radially due to the inclined orientation of the retaining dovetail 26 on which the blades 24 are guided. As an example of the amount of radial extension of the blades 24 the run in dimension for one size can be 4.375 inches and increase to 4.625 inches in the set position. The slope of the dovetail and the amount of the available axial travel determines the dimensional increase for the outer diameter of the blades 24 in the set position.

The above description is illustrative of the preferred embodiment and many modifications may be made by those skilled in the art without departing from the invention whose scope is to be determined from the literal and equivalent scope of the claims below:

I claim:

1. A borehole milling tool for milling an object in the borehole, comprising:

a mandrel;

a plurality of spaced blades supported from said mandrel in a retracted and extended positions;

said blades moving from said retracted to said extended position when brought into contact with the object and said mandrel moves relatively to said blades;

said mandrel further comprises a follower ring biased away from a gage ring with a biasing member located therebetween, whereupon relative movement between said blades and said mandrel in a first direction, said biasing member biases said follower ring and said blades in tandem in an opposite direction.

2. A borehole milling tool for milling an object in the borehole, comprising:

a mandrel;

a plurality of spaced blades supported from said mandrel in a retracted and extended positions;

said blades moving from said retracted to said extended position when brought into contact with the object and said mandrel moves relatively to said blades;

said mandrel further comprises a follower ring initially shear pinned to said mandrel, whereupon setting down weight on said mandrel with said blades contacting the object said shear pin shears and compresses a return spring against a gage ring secured to said mandrel.

3. The tool of claim 2, wherein:

said mandrel is moved with set down weight.

4. The tool of claim 2, wherein:

said mandrel moves axially relative to said blades between said retracted and extended positions.

5. The tool of claim 2, wherein:

said blades are slidably mounted to said mandrel.

6. The tool of claim 2, wherein:

said blades are retained to said mandrel with a dovetail.

7. The tool of claim 2, wherein:

said blades are biased to said retracted position.

8. The tool of claim 7, wherein:

said biasing comprises a spring or compressible fluid.

9. The tool of claim 2, wherein:

said blades are selectively secured to said mandrel in said retracted position until force is applied to said mandrel.

10. The tool of claim 9, wherein:

said selective securing is accomplished with at least one breakable member.

11. The tool of claim 2, wherein:

said blades comprise cutting structure on at least a lower end thereof.

12. The tool of claim 2, wherein:

said blades extend axially beyond an end of said mandrel in said retracted position.

13. A borehole milling method for removal of an object, comprising:

running in a mill with a plurality of movable blades in a retracted position;

landing said blades on the object;

relatively moving a mandrel with respect to said blades when said blades are landed on the object;

extending said blades to an extended position due to said relatively moving said mandrel;

providing a follower ring on said mandrel biased away from a gage ring with a biasing member located therebetween, whereupon relative movement between said blades and said mandrel in a first direction, said biasing member biases said follower ring and said blades in tandem in an opposite direction.

14. The method of claim 13, comprising:

using set down weight on said mandrel for relatively moving said mandrel.

15. The method of claim 13, comprising:

positioning said blades to initially extend axially beyond an end of said mandrel is said retracted position.

16. The method of claim 13, comprising:

initially securing said blades to said mandrel with a breakable member.

17. The method of claim 13, comprising:

guiding said blades with respective inclined dovetails such that relative movement of said mandrel with respect to said blades in contact with the object moves said blades radially to said extended position.

* * * * *